US010236137B2

(12) United States Patent
Raikar et al.

(10) Patent No.: US 10,236,137 B2
(45) Date of Patent: Mar. 19, 2019

(54) MULTI-POLE SWITCH ASSEMBLY WITH ADJUSTABLE SIMULTANEITY

(71) Applicant: Honeywell International Inc., Morris Plains, NJ (US)

(72) Inventors: Venkatesh Raikar, Bangalore (IN); Vivin Sebastian, Bangalore (IN); Mark A. Mantua, Freeport, IL (US); Balaji K. Krishnaswamy, Bangalore (IN)

(73) Assignee: Honeywell International Inc., Morris Plains, NJ (US)

( * ) Notice: Subject to any disclaimer, the term of this patent is extended or adjusted under 35 U.S.C. 154(b) by 98 days.

(21) Appl. No.: 15/233,565

(22) Filed: Aug. 10, 2016

(65) Prior Publication Data

US 2017/0053757 A1 Feb. 23, 2017

(51) Int. Cl.

| | |
|---|---|
| ***H01H 19/54*** | (2006.01) |
| ***H01H 13/14*** | (2006.01) |
| *H01H 13/50* | (2006.01) |
| *H01H 3/32* | (2006.01) |

(52) U.S. Cl.

CPC ..... *H01H 13/14* (2013.01); *H01H 13/503* (2013.01); *H01H 2003/323* (2013.01)

(58) Field of Classification Search

CPC .. H01H 19/54; H01H 19/14; H01H 2003/323; H01H 13/14; H01H 13/503; H01H 2235/01; H01H 31/003; H01H 19/02; H01H 19/58

USPC ..... 200/5 R, 4, 14, 11 TC

See application file for complete search history.

(56) References Cited

U.S. PATENT DOCUMENTS 3,309,471 A * 3/1967 Korrell ..... H01H 11/06 200/11 E
3,543,200 A * 11/1970 Hill ..... H01H 36/0053 335/206
3,584,163 A * 6/1971 White ..... H01H 19/11 200/11 G
5,049,709 A * 9/1991 Prickett ..... H01H 13/585 200/253

OTHER PUBLICATIONS

European Search Report and Opinion in related European Application No. EP 16183903, dated Jan. 2, 2017, 8 pages.
Response to European Search Report and Opinion in related European Application No. EP 16183903, filed Mar. 20, 2017, 17 pages.

* cited by examiner

*Primary Examiner* — Edwin A. Leon
(74) *Attorney, Agent, or Firm* — Craige Thompson; Thompson Patent Law

(57) ABSTRACT

A multi-pole switch assembly includes a housing, a plurality of switches, and an actuator. The switches are disposed within the housing, and each switch is coupled to receive an actuation force and is configured, upon receipt of the actuation force, to move between a first position and a second position. The actuator is disposed at least partially within the housing and is configured to at least substantially simultaneously engage, and thereby supply the actuation force to, each switch to thereby move all of the switches, with substantial simultaneity, to either the first or the second position. The actuator is rotatable to a plurality of set rotational positions to thereby vary the substantial simultaneity.

15 Claims, 9 Drawing Sheets

MULTI-POLE SWITCH ASSEMBLY WITH ADJUSTABLE SIMULTANEITY

CROSS REFERENCE TO RELATED APPLICATIONS

The present application claims priority to India Provisional Patent Application No. 2557/DEL/2015 filed Aug. 19, 2015 by Venkatesh Raikar, et al. and entitled "MULTI-POLE SWITCH ASSEMBLY WITH ADJUSTABLE SIMULTANEITY," which is incorporated herein by reference as if reproduced in its entirety.

TECHNICAL FIELD

The present invention generally relates to switches, and more particularly relates to a multi-pole switch assembly with adjustable simultaneity.

BACKGROUND

Electrical switches typically operate to open and close an electrical circuit by moving one or more contacts between contact positions. A switch that is used to control one circuit is known as a single pole switch. In many instances, two or more switches are used to simultaneously energize or de-energize two or more devices. For such instances, a multi-pole switch arrangement may be used. Depending on the application, the difference in the timing between the on/off times of the switch poles (i.e., the "simultaneity") can be important and may be regulated as maximum specified values through various industry, agency, or military standards. Many times, the specified simultaneity can be relatively difficult to achieve. This can be especially true when precision switches are needed with very precise and repeatable on/off positions and/or small differential travels (which is the difference in the on and off position). Low simultaneity in switch applications can be further complicated by slow switch actuation speeds.

Achieving low simultaneity, such as a maximum of 0.06 millimeters (mm) between switching of each pole, can be relatively difficult. This is due, in part, to variations in part tolerances and in basic switch operating characteristics. Moreover, maintaining low simultaneity throughout the life of the switch can also be challenging, as it too requires relatively narrow part tolerances and relatively high process, both of which increase overall switch cost.

Hence, there is a need for a multi-pole switch assembly for which relatively low simultaneity can be both achieved and maintained required without relying on narrow part tolerances, high process times, and that will not increase overall switch cost. The present invention addresses at least this need.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, a multi-pole switch assembly includes a housing, a plurality of switches, and an actuator. The switches are disposed within the housing, and each switch is coupled to receive an actuation force and is configured, upon receipt of the actuation force, to move between a first position and a second position. The actuator is disposed at least partially within the housing and is configured to at least substantially simultaneously engage, and thereby supply the actuation force to, each switch to thereby move all of the switches, with substantial simultaneity, to either the first or the second position. The actuator is rotatable to a plurality of set rotational positions to thereby vary the substantial simultaneity.

In another embodiment, a multi-pole switch assembly includes a housing, a plurality of switches, and an actuator. Thea housing has a first indexing feature formed thereon. The switches are disposed within the housing, and each switch is coupled to receive an actuation force and is configured, upon receipt of the actuation force, to move between a first position and a second position. The actuator is disposed at least partially within the housing and is configured to at least substantially simultaneously engage, and thereby supply the actuation force to, each switch to thereby move all of the switches, with substantial simultaneity, to either the first or the second position. The actuator is rotatable to a plurality of set rotational positions to thereby vary the substantial simultaneity, and includes a shaft, a switch engagement portion, and a plurality of features. The shaft has a first end and a second end, and also has a second indexing feature formed thereon. The switch engagement portion is connected to the second end of the shaft, and has a first side and a second side. The first side is connected to the shaft and faces away from the switches. The second side faces and at least substantially simultaneously engages the switches. The features are formed on the second side of the switch engagement portion. Each feature is associated with a different one of the plurality of set rotational positions. The first and second indexing features are configured to maintain the actuator in one of the set rotational positions.

Furthermore, other desirable features and characteristics of the switch assembly will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims.

Furthermore, there is no intention to be bound by any expressed or implied theory presented in the preceding technical field, background, brief summary, or the following detailed description. In this regard, although embodiments of the multi-pole switches described herein are configured as double-pole, double-throw (DPDT) type of switches, it will be appreciated that switches having more than two poles are also contemplated herein.

Figure 1:
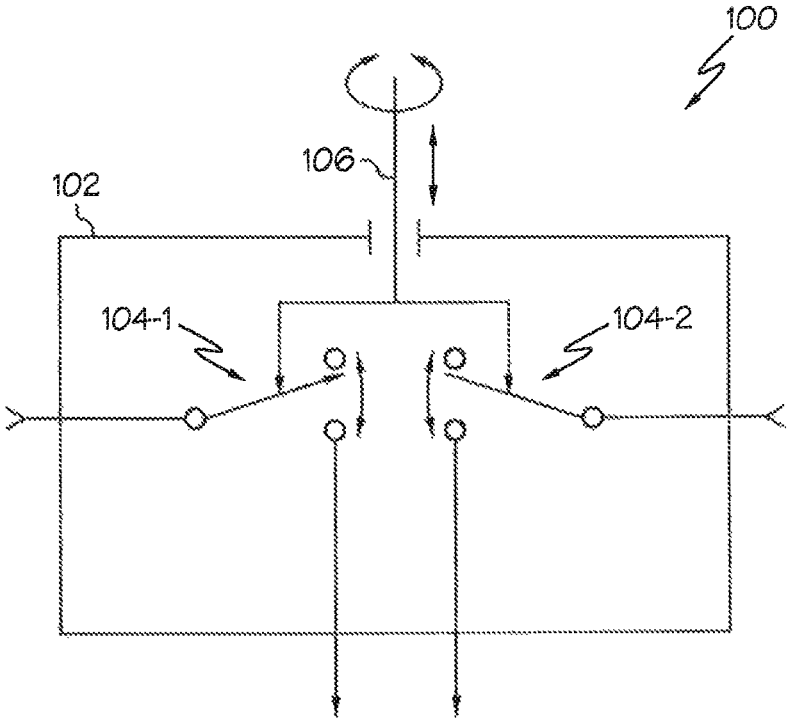
FIG. 1 is a schematic representation of one embodiment of a multi-pole switch assembly with adjustable simultaneity.

Referring now to FIG. 1, a schematic representation of one embodiment of a multi-pole switch assembly with adjustable simultaneity is depicted. The switch assembly 100 includes a housing 102, a plurality of switches 104 (e.g., 104-1, 104-2), and an actuator 106. The switches 104 are each disposed within the housing 102, and each is coupled to receive an actuation force from the actuator 106. Each of the switches 104 is configured, upon receipt of the actuation force, to move between a first position, which is the position depicted in FIG. 1, and a second position, which is not depicted. Although the depicted switch assembly 100 is implemented using only two switches 104, it will be appreciated that it could be implemented with more than this number of switches. It will additionally be appreciated that the switches 104 could be variously configured and implemented. In the depicted embodiment, however, each is configured and implemented as a single-pole, double-throw (SPDT) switch, whereby the switch assembly 100 is configured and implemented as a DPDT switch.

Regardless of the number and type of switches 104, the actuator 106 is disposed at least partially within the housing 102 and is configured to at least substantially simultaneously engage, and thereby supply the actuation force to, each switch 104. As a result, the switches 104 may be moved with substantial simultaneity to either the first or the second position. The actuator 106 is also configured to be rotated. In particular, and as will be described in more detail further below, it is rotatable to a plurality of set rotational positions to thereby vary the substantial simultaneity.

Before proceeding further, it is noted that the term "substantial simultaneity" as used herein means that the switches, when moved from the first position to the second position and vice-versa, are switched within 0.06 millimeters (mm) of each other. That is, the actuator 106 travels no more than 0.06 mm between the switching of the switches. To illustrate this concept more clearly, assume that when an actuation force is supplied to the actuator 106 to move the switches 104 from the first position to the second position (or from the second position to the first position), and that the first switch 104-1 moves to the second position (or the first position) before the second switch 104-2. Thus, to move the second switch 104-2 to the second position (or the first position), the actuator 106 will have to be moved further. If this further movement of the actuator 106 is less than or equal to 0.06 mm, then the switches 104 are moved with substantial simultaneity. If this further movement exceeds 0.06 mm, then the switches 104 are not moved with substantial simultaneity.

Figure 2:
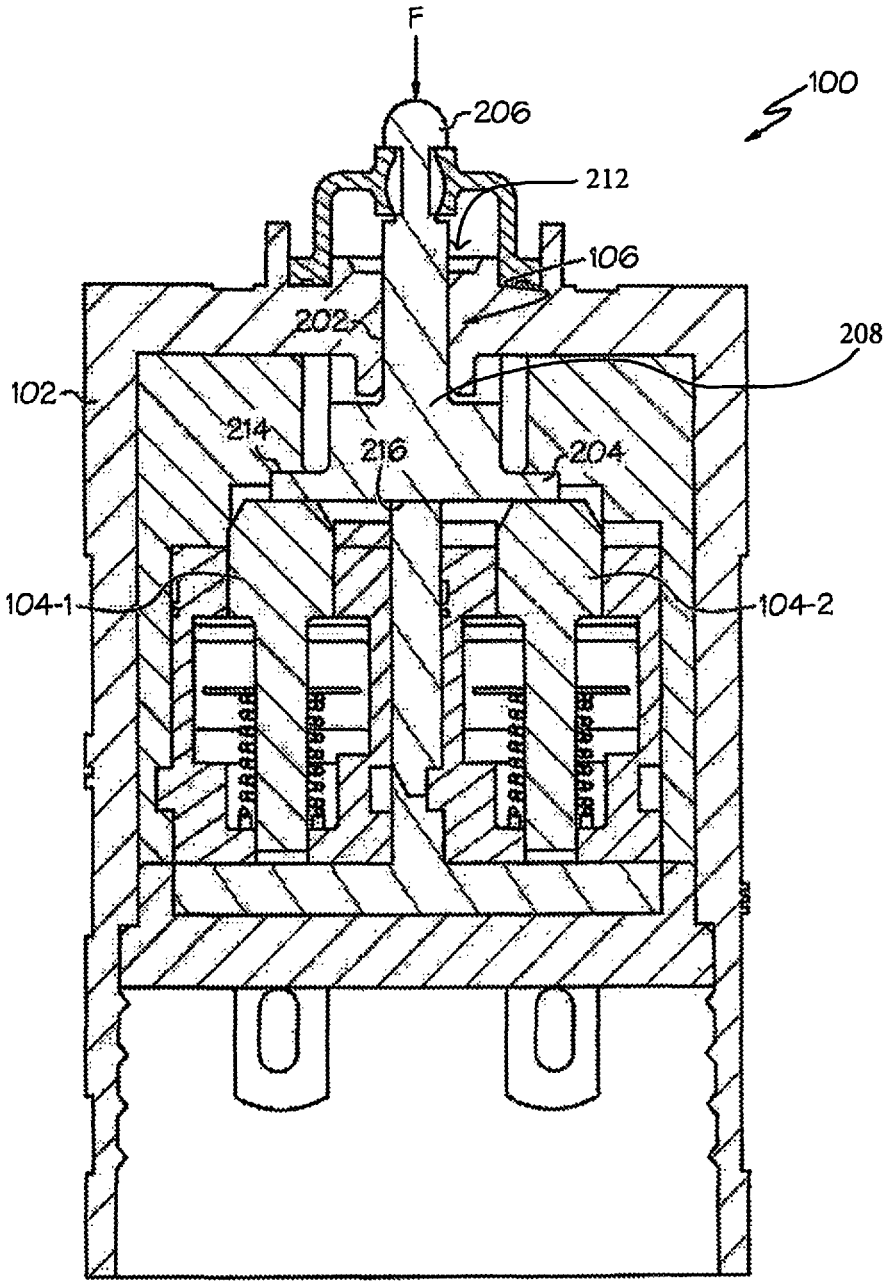
FIG. 2 is a cross section view of one particular physical implementation of the multi-pole switch assembly illustrated in FIG. 1.

Returning once again to the description, and with reference now to FIG. 2, a more detailed description of the switch assembly 100, and more particularly the actuator 106 and how it is configured to implement its functionality, will be provided. As shown more clearly in FIG. 2, the actuator 106 includes a shaft 202 and a switch engagement portion 204. The shaft 202 has a first end 206 and a second end 208. The first end 206 extends through an opening 212 in the housing 102 and the second end 208 is connected to the switch engagement portion 204. The switch engagement portion 204 has a first side 214 and a second side 216. The first side 214 is connected to the shaft 202 and faces away from the switches 104. The second side 216, however, faces the switches 104 and, in addition, at least substantially simultaneously engages the switches 104.

The actuator 106, and more specifically the first end 206 of the shaft 202, is configured to receive a force (F) in the direction indicated in FIG. 2. This force (F), when supplied to the actuator 106, is transferred to the switches 104, via the shaft engagement portion 204, whereby the switches 104 are moved, with substantial simultaneity, between the first and second positions. The actuator 106, and more specifically the first end 206 of the shaft 202, is also configured to be grasped by a hand or a suitable tool to rotate the actuator 106 to one of the set rotational positions to thereby vary, as needed, the substantial simultaneity of the switches 102.

Figure 3:
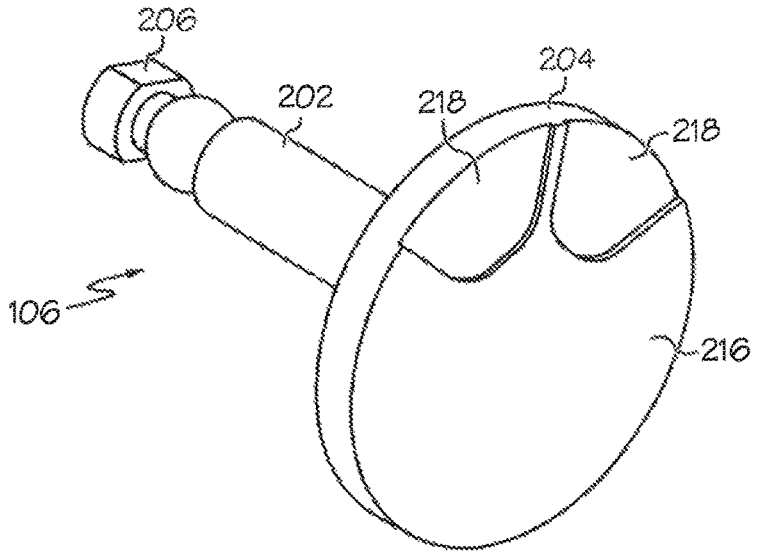
FIGS. 3-6 are plan views of various embodiments of an actuator that may be used in the multi-pole switch assembly illustrated in FIG. 2.

As shown more clearly in FIG. 3, the actuator 106 additionally includes a plurality of features 218. The features 218 are formed on the second side 216 of the switch engagement portion 204, and each is associated with a different one of the plurality of set rotational positions. The features 218 vary in dimension and are what implements the variation in the substantial simultaneity of the switches 104. Although the embodiment depicted in FIG. 3 includes only two features 218, it will be appreciated that the actuator 106 could include more than this number of features 218.

Figure 4:
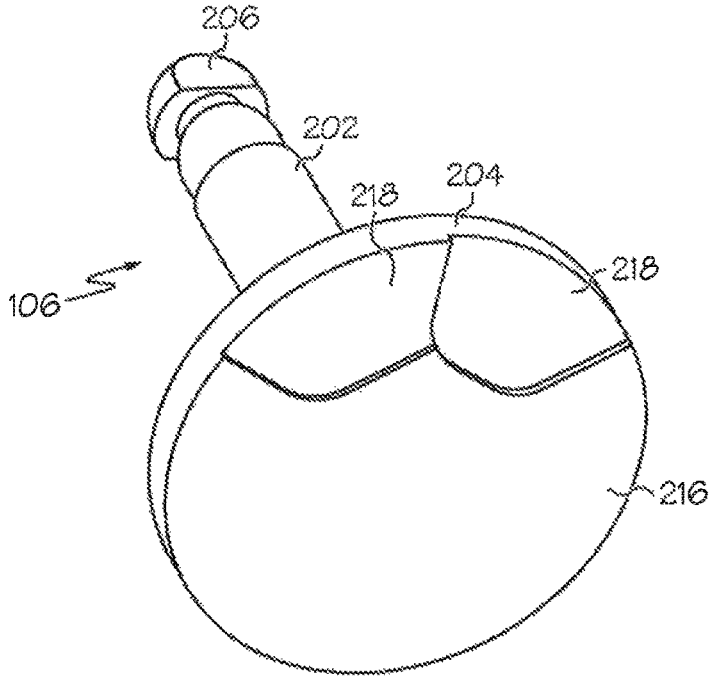
Figure 5:
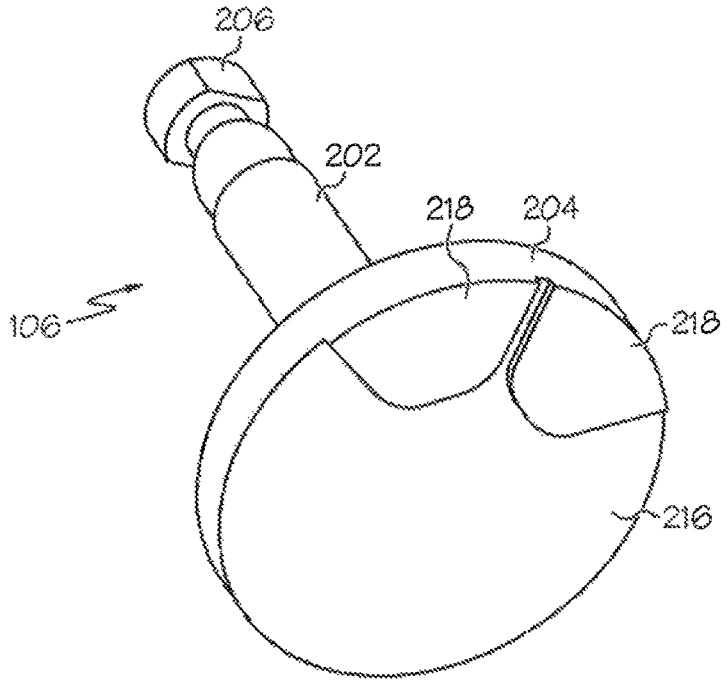
Figure 6:
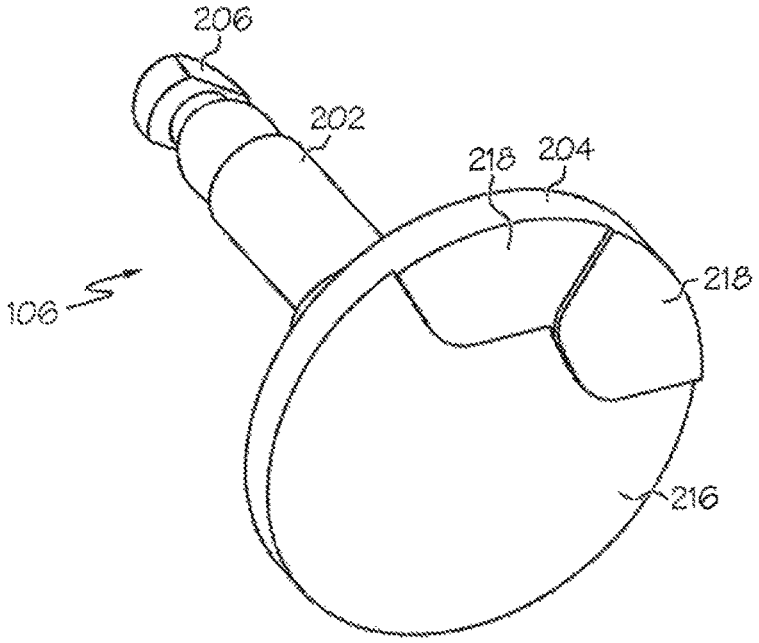

It will be appreciated that, the features 218 may be variously configured. For example, in the embodiment depicted in FIG. 3, each feature 218 is a configured as a pocket having a depth, and the depth of each pocket is different. In the embodiment depicted in FIG. 3, each pocket has a constant depth, whereas in other embodiments, as illustrated in FIG. 4, each pocket is configured as a cam surface. In yet other embodiments, such as the one depicted in FIG. 5, each feature is a protrusion having a height, and the height of each protrusion is different. As with the previously described embodiments, the each protrusion may be configured to have a constant height (FIG. 5) or be configured as a cam surface (FIG. 6).

To ensure the actuator remains in the desired set rotational position the switch assembly 100 additionally includes a pair of indexing features a first indexing feature and a second indexing feature. The first indexing feature is formed on the housing 102 and the second indexing feature formed on the shaft 202, and the indexing features are configured to maintain the actuator 106 in one of the set rotational positions. As may be appreciated, the manner in which the indexing features are configured and implemented may vary. Some of the variations in configuration and implementation will now be described.

Figure 7:
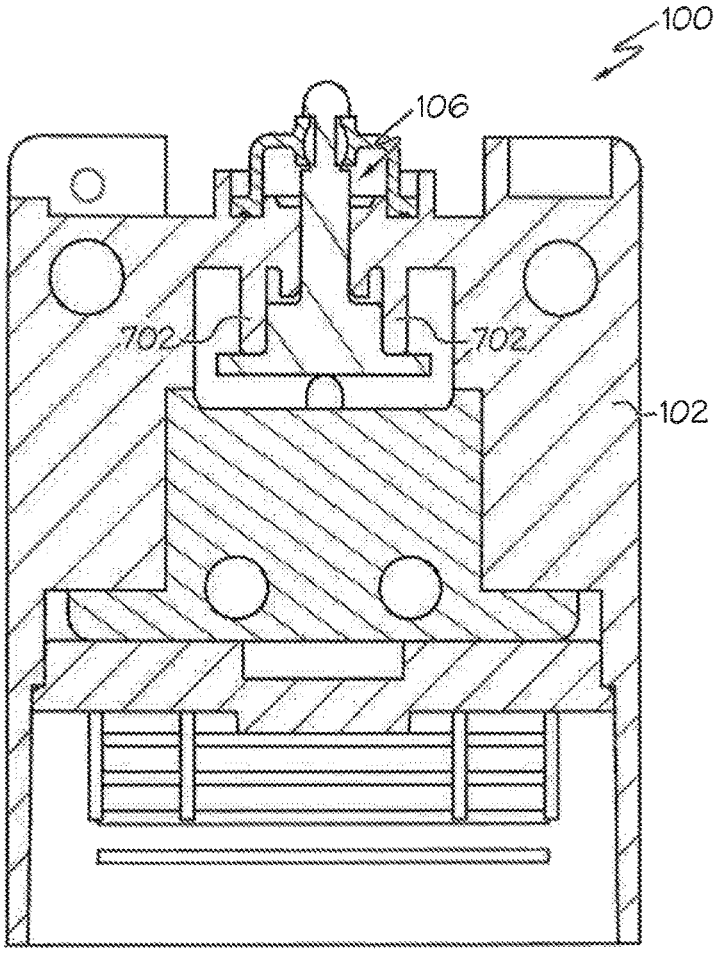
FIG. 7 is another cross section view of the multi-pole switch assembly illustrated in FIG. 2.
Figure 8:
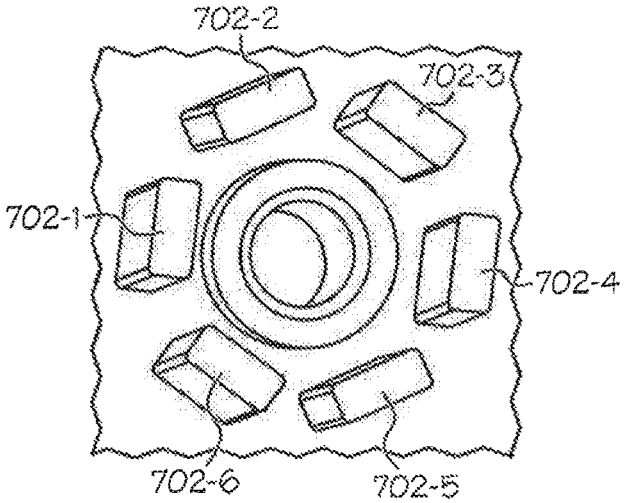
FIG. 8 depicts an embodiment of a first indexing feature that may be implemented in the multi-pole switch assembly illustrated in FIG. 7.

In one embodiment, which is depicted in FIGS. 7 and 8, the first indexing feature comprises a plurality of cantilever features 702 (e.g., 702-1, 702-1 . . . , 702-N). Each cantilever feature 702 extends from the housing 102 toward the switches 104 and, as shown most clearly in FIG. 8, each is spaced apart from two other adjacent cantilever features 702 to form a gap. As may be appreciated, each of these gaps corresponds to a different one of the set rotational positions. As may additionally be appreciated, the number of cantilever features 702 (and thus the number of gaps) may vary, as needed or desired. In the depicted embodiment, the first indexing feature is implemented with six cantilever features 702, thereby providing six different set rotational positions.

Figure 9:
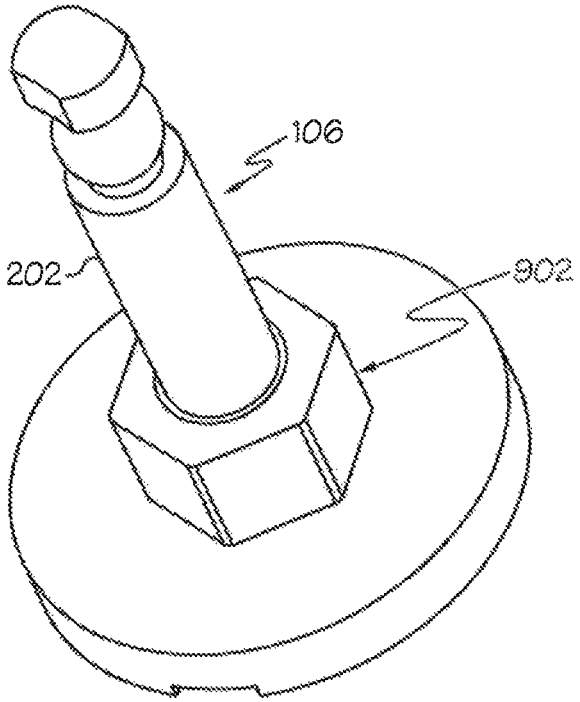
FIG. 9 depicts a plan view of an actuator with a second indexing feature that may be implemented in the multi-pole switch assembly illustrated in FIG. 7.
Figure 10:
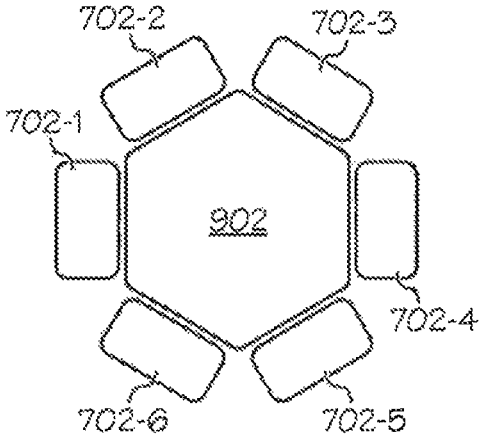
FIGS. 10 and 11 illustrate the operation of the actuator and how the first and second indexing features of FIGS. 8 and 9 cooperate during operation.
Figure 11:
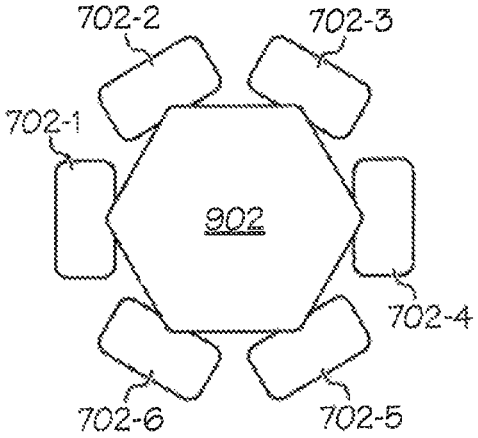

The second indexing feature, as noted above, is formed on the shaft 202. In one embodiment, which is depicted in FIG. 9, it comprises a polygon 902 having a plurality of equally dimensioned sides. Thus, as shown in FIG. 10, when the actuator 106 is in one of the set rotational positions, the corners of the polygon 902 disposed adjacent one of the gaps, and the actuator 106 is inhibited from rotating out of the set rotational position. Preferably, the cantilever features 702 are configured to slightly flex so that, as FIG. 11 depicts, when the actuator 106 is rotated to a different set rotational position, a slight interference is provided between the cantilever features 702 and the corners of the polygon 902.

Figure 12:
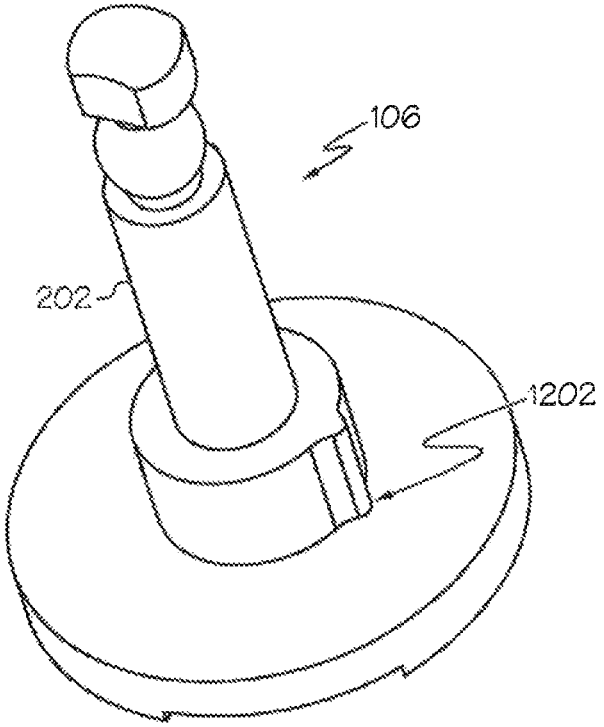
FIG. 12 depicts a plan view of an actuator with another embodiment of a second indexing feature that may be implemented in the multi-pole switch assembly illustrated in FIG. 7.
Figure 13:
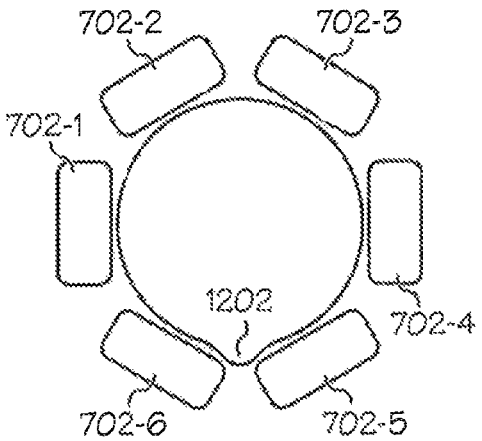
FIGS. 13 and 14 illustrate the operation of the actuator and how the first and second indexing features of FIGS. 8 and 12 cooperate during operation.
Figure 14:
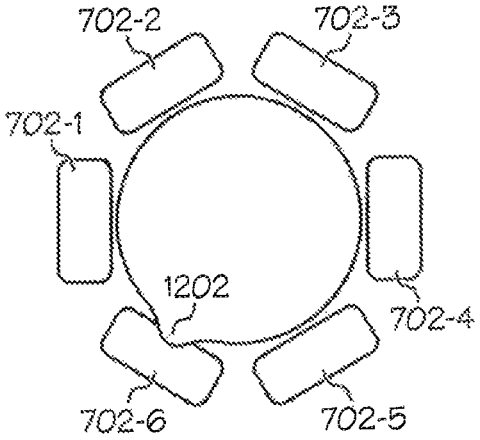

In another embodiment, which is depicted in FIG. 12, the second indexing feature comprises a protrusion 1202 that extends radially outwardly from the shaft 202. As FIG. 13 depicts, when the actuator 106 is in one of the set rotational positions, the protrusion 1202 is disposed within one of the gaps, and the actuator 106 is inhibited from rotating out of the set rotational position. As FIG. 14 depicts, when the actuator 106 is rotated to a different set rotational position, a slight interference is provided between the cantilever features 702 and the protrusion 1202.

Figure 15:
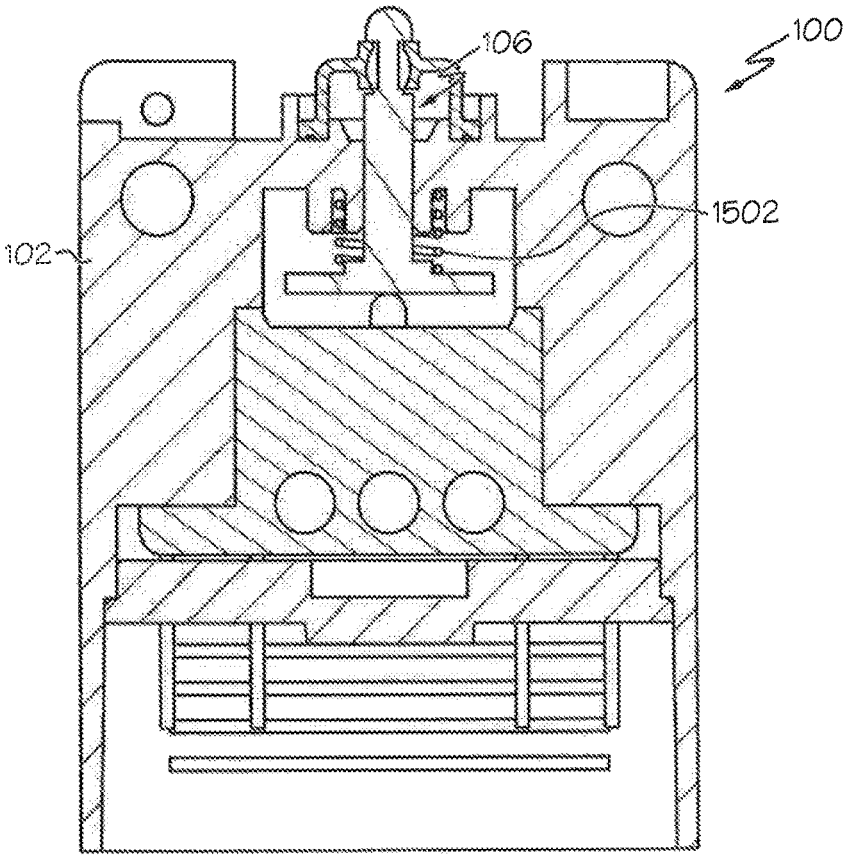
FIGS. 15-17 illustrate another embodiment of a switch assembly with different types of first and second indexing features.
Figure 16:
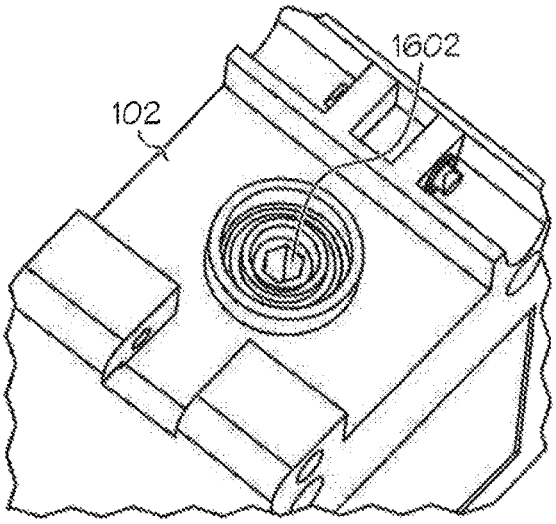
Figure 17:
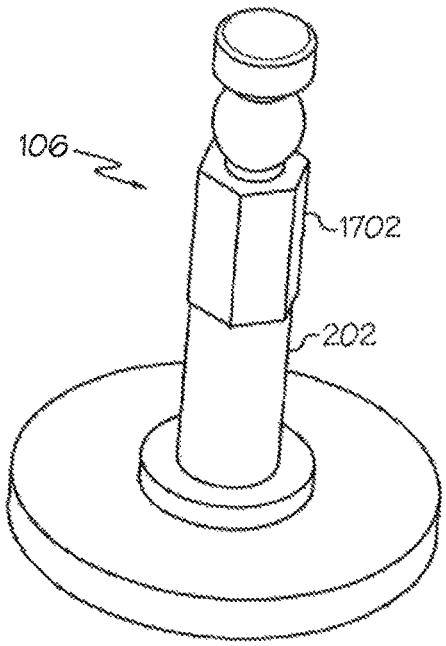

In yet another embodiment, which is depicted in FIGS. 15-17, the first indexing feature comprises an opening 1602 (see FIG. 16) having a polygonal cross section, and the second indexing feature comprises a polygon 1702 (see FIG. 17) that is configured to mate with the opening 1602. As FIG. 15 also depicts, when this embodiment is implemented the switch assembly 100 additionally includes a bias spring 1502. The bias spring 1502 is disposed between, and engages, the housing 102 and the actuator 106, and provides a force to the actuator 106 that maintains the polygon 1702 within the opening 1602. To rotate the actuator 106 between set rotational positions, the actuator 106 is pulled upwardly, against the force of the bias spring 1502, until the polygon 1702 is outside of the opening 1602. The actuator 106 may then be rotated to the desired set rotational position, and then released. The force from the bias spring 1502 then pushes the polygon 1702 back into the opening 1602.

Figure 18:
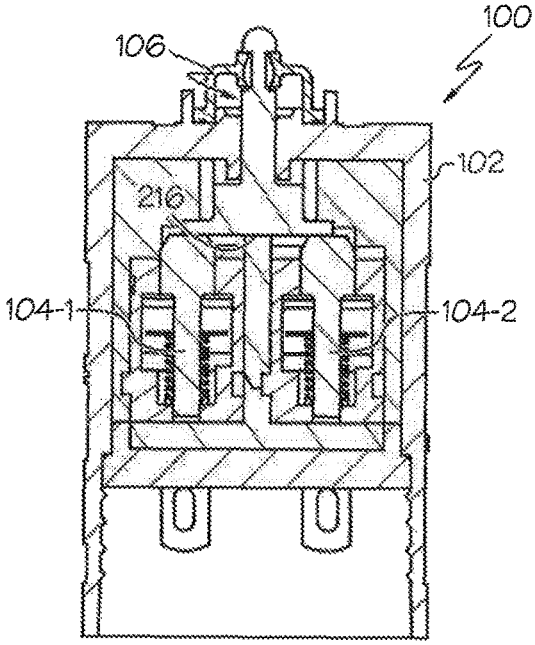
FIGS. 18 and 19 illustrate how the switch assemblies depicted herein provide adjustable simultaneity.
Figure 19:
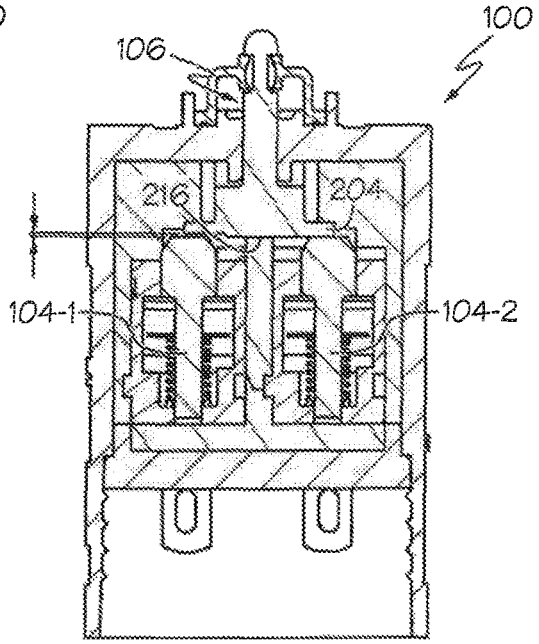

The switch assembly embodiments described herein provide a multi-pole switch assembly for which relatively low simultaneity can be both achieved and maintained. To illustrate how this may be achieved, reference should now be made to FIGS. 18 and 19. If, when the actuator 106 is in the position depicted in FIG. 18, one of the switches 104-1 switches positions 0.06 mm of actuator travel before the other switch 104-2, then substantial simultaneity is not achieved. As a result, the actuator 106 is rotated to another set rotational position, as depicted in FIG. 19, thereby aligning one of the features 218 with the switch 104-1 that was actuating first. Thus, there is now an increased gap between the second side 216 of the switch engagement portion 204 and the switch 104-1 that was actuating first, thereby improving the simultaneity. As may be appreciated, if the simultaneity needs further improvement, the actuator 106 may be rotated again to another set rotational position.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A multi-pole switch assembly, comprising:

a housing;

a plurality of switches disposed within the housing, each switch coupled to receive an actuation force and configured, upon receipt of the actuation force, to move between a first position and a second position; and an actuator disposed at least partially within the housing and configured to at least substantially simultaneously engage, and thereby supply the actuation force to, each switch to thereby move all of the switches, with substantial simultaneity, to either the first or the second position, wherein the actuator is rotatable to a plurality of set rotational positions to thereby vary the substantial simultaneity.

2. The multi-pole switch assembly of claim 1, wherein the actuator comprises:

a shaft having a first end and a second end;

a switch engagement portion connected to the second end of the shaft, the switch engagement portion having a first side and a second side, the first side connected to the shaft and facing away from the switches, the second side facing and at least substantially simultaneously engaging the switches; and a plurality of features formed on the second side of the switch engagement portion each feature associated with a different one of the plurality of set rotational positions.

3. The multi-pole switch assembly of claim 2, wherein:

each feature is a pocket having a depth; and the depth of each pocket is different.

4. The multi-pole switch assembly of claim 3, wherein each pocket is configured as a cam surface.

5. The multi-pole switch assembly of claim 2, wherein:

each feature is a protrusion having a height; and the height of each protrusion is different.

6. The multi-pole switch assembly of claim 2, wherein each protrusion is configured as a cam surface.

7. The multi-pole switch of claim 2, further comprising:

a first indexing feature formed on the housing; and a second indexing feature formed on the shaft, wherein the first and second indexing features configured to maintain the actuator in one of the set rotational positions.

8. The multi-pole switch of claim 7, wherein the first indexing feature comprises a plurality of cantilever features extending from the housing, each cantilever feature spaced apart from two other adjacent cantilever features to form a gap, each gap corresponding to a different one of the set rotational positions.

9. The multi-pole switch of claim 8, wherein the second indexing feature comprises a polygon having a plurality of equal sized sides.

10. The multi-pole switch of claim 8, wherein the second indexing feature comprises a protrusion extending radially outwardly from the shaft.

11. The multi-pole switch of claim 7, wherein:

the first indexing feature comprises an opening having a polygonal cross section; and the second indexing feature comprises a polygon configured to mate with the opening.

12. The multi-pole switch of claim 11, further comprising:

a bias spring disposed between, and engaging, the housing and the actuator, the bias spring providing a force to the actuator that maintains the second indexing feature within the opening.

13. A multi-pole switch assembly, comprising:

a housing having a first indexing feature formed thereon;

a plurality of switches disposed within the housing, each switch coupled to receive an actuation force and configured, upon receipt of the actuation force, to move between a first position and a second position; and an actuator disposed at least partially within the housing and configured to at least substantially simultaneously engage, and thereby supply the actuation force to, each switch to thereby move all of the switches, with substantial simultaneity, to either the first or the second position, wherein the actuator is rotatable to a plurality of set rotational positions to thereby vary the substantial simultaneity, and comprises:

a shaft having a first end and a second end, the shaft having a second indexing feature formed thereon, a switch engagement portion connected to the second end of the shaft, the switch engagement portion having a first side and a second side, the first side connected to the shaft and facing away from the switches, the second side facing and at least substantially simultaneously engaging the switches, and a plurality of features formed on the second side of the switch engagement portion, each feature associated with a different one of the plurality of set rotational positions, wherein the first and second indexing features configured to maintain the actuator in one of the set rotational positions.

14. The multi-pole switch of claim 13, wherein the first indexing feature comprises a plurality of cantilever features extending from the housing, each cantilever feature spaced apart from two other adjacent cantilever features to form a gap, each gap corresponding to a different one of the set rotational positions.

15. The multi-pole switch assembly of claim 14, wherein:

each feature is a pocket having a depth; and the depth of each pocket is different.

* * * * *